United States Patent [19]

Kurio

[11] 3,961,871

[45] June 8, 1976

[54] CORNER SEAL MEANS FOR ROTARY PISTON TYPE ENGINES

[75] Inventor: Noriyuki Kurio, Hiroshima, Japan

[73] Assignee: Toyo Kogyo Co., Ltd., Japan

[22] Filed: Jan. 16, 1975

[21] Appl. No.: 541,572

[30] Foreign Application Priority Data

Jan. 23, 1974 Japan ..... 49-10646[U]
Nov. 8, 1974 Japan ..... 49-135850[U]

[52] U.S. Cl. ..... 418/121; 418/123
[51] Int. Cl.[2] ..... F01C 19/10
[58] Field of Search ..... 418/61 A, 112, 113, 418/124, , 138, 142, 241, 121, 122, 123

[56] References Cited

UNITED STATES PATENTS

| | | | |
|---|---|---|---|
| 3,180,560 | 4/1965 | Paschke | 418/61 A |
| 3,860,365 | 1/1975 | Bibbens | 418/142 |

FOREIGN PATENTS OR APPLICATIONS

| | | | |
|---|---|---|---|
| 1,154,683 | 9/1963 | Germany | 418/142 |

*Primary Examiner*—C. J. Husar
*Attorney, Agent, or Firm*—Fleit & Jacobson

[57] ABSTRACT

Rotary piston type internal combustion engine including corner seals adapted to be received in corner seal recesses provided in each corner portion of a rotor, said corner seal comprising a substantially cylindrical body, an axial bore of circular cross-section axially offset from the axis of the body, and a substantially radially extending slot provided in the body at the side opposite to the direction of offset of the bore so as to define a substantially C-shaped cross-section of varying wall thickness. The configuration of the corner seal is effective to provide it with radial resiliency and also ensure uniform contact pressure against the wall surface of the recess throughout the periphery thereof.

4 Claims, 7 Drawing Figures

CORNER SEAL MEANS FOR ROTARY PISTON TYPE ENGINES

The present invention relates to rotary piston type internal combustion engines and more particularly to corner seal means therefore.

In a rotary piston type engine comprising a casing which includes a rotor housing with a trochoidal inner peripheral wall and a pair of side housings sealingly secured to the opposite sides of the rotor housing, and a polygonal rotary piston disposed in the casing for rotation relative thereto and having a plurality of apex portions, the rotary piston is provided with apex seals, side seals and corner seals. The apex seals are provided at each apex portion of the rotary piston for sliding contact with the inner peripheral wall of the rotor housing so as to define with the rotor housing, a working chamber between each two adjacent apex seals. The side seals are provided on each end surface of the rotary piston and extend substantially along the periphery thereof. The apex and side seals are disposed in grooves formed in the rotary piston for the purpose. The corner seals are disposed on each end surface of the rotary piston at the apex portions thereof. Usually, the piston is provided at each apex portion of each end surface with a cylindrical recess in which the corner seal is received.

During operation of the engine, the apex seals and the side seals are forced under combustion gas pressure toward one side of the associated grooves so that gas leakage along the grooves for these seals can be substantially prevented. However, in a conventional seal arrangement, appreciable gas leakage is produced through clearances between the corner seals and the cylindrical recesses unless the dimensions of the seals and the recesses are precisely controlled. Even when the clearances are maintained at minimum values during manufacture, the corner seals themselves or the wall surfaces of the seal recesses are worn through prolonged operations of engine with the result that the clearances between the corner seals and the seal recesses are increased to such extents that appreciable amount of gas may be allowed to leak therethrough.

In order to eliminate the above problem, the U.S. Pat. No. 3180560 teaches the provision of radially resilient corner seals which are expanded radially outwardly in the associated seal recesses, under their own resiliency and/or under the pressure of gas introduced from the working chambers into the corner seals, into close contact with the wall surfaces of the associated grooves. However, the corner seal as taught by the patent is not effective to provide uniform radially directed contact pressure throughout the periphery thereof since it has a uniform wall thickness.

The present invention therefore has an object to provide corner seal means for rotary piston engines which can effectively prevent gas leakage along the outer surface thereof.

Another object of the present invention is to provide corner seal means for rotary piston engines which can be brought into substantially uniform contact with the wall surface of seal receiving recess throughout the periphery thereof.

The above and other objects can be achieved, in accordance with the present invention, by providing corner seal means comprising a substantially cylindrical body, an axial bore of circular crosssection axially offset from the axis of the body, and a substantially radially extending slot provided in the body at the side opposite to the direction of offset of the bore so as to define a substantially C-shaped cross-section of varying wall thickness. According to the present invention, the wall thickness of the corner seal gradually decreases from the opposite sides adjacent to the slot toward the intermediate portion thereof with minimum value at the intermediate portion. The configuration of the corner seal of the present invention is found as being effective to provide a uniform contact pressure against the wall surface of the seal receiving recess throughout the whole peripheral length thereof.

During engine operation, gas pressure is introduced into the bore of the seal through the slot so that it is expanded radially outwardly into close contact with the wall surface of the seal receiving recess. In a preferred aspect of the present invention, however, the corner seal has an outer diameter which is slightly greater than the seal receiving recess under an unrestricted condition, so that it has an outwardly expanding tendency when it is received in the recess. Further, the outer surface of the seal may be chamfered at the areas adjacent to the slot so as to ensure improved uniform contact with the wall surface of the seal recess.

The above and other objects and features of the present invention will become apparent from the following descriptions of preferred embodiments taking reference to the accompanying drawings, in which.

Figure 4:
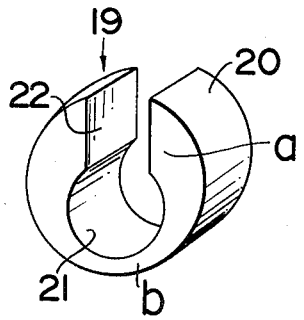
FIG. 4 is a perspective view showing the general configuration of the corner seal used in the embodiment of FIG. 1.
Figure 5:
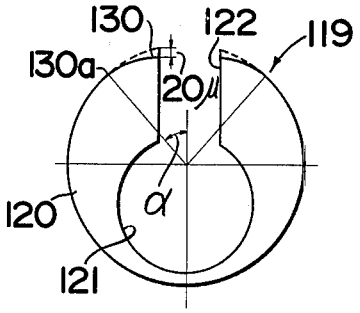
FIG. 5 is an end view of the corner seal in accordance with another embodiment of the present invention.
Figure 6:
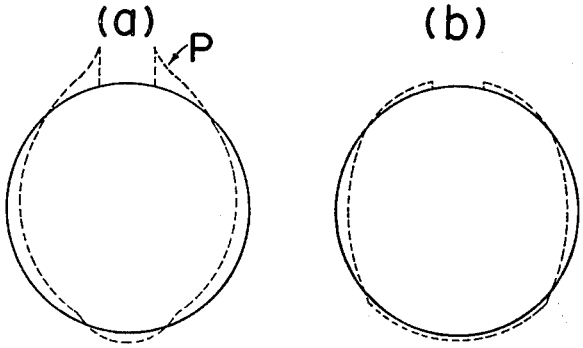

FIG. 6*a* shows pressure distribution along the external surface of the corner seal shown in FIG. 4 when it is in use; and FIG. 6*b* shows pressure distribution in the modified corner seal shown in FIG. 5.

Figure 1:
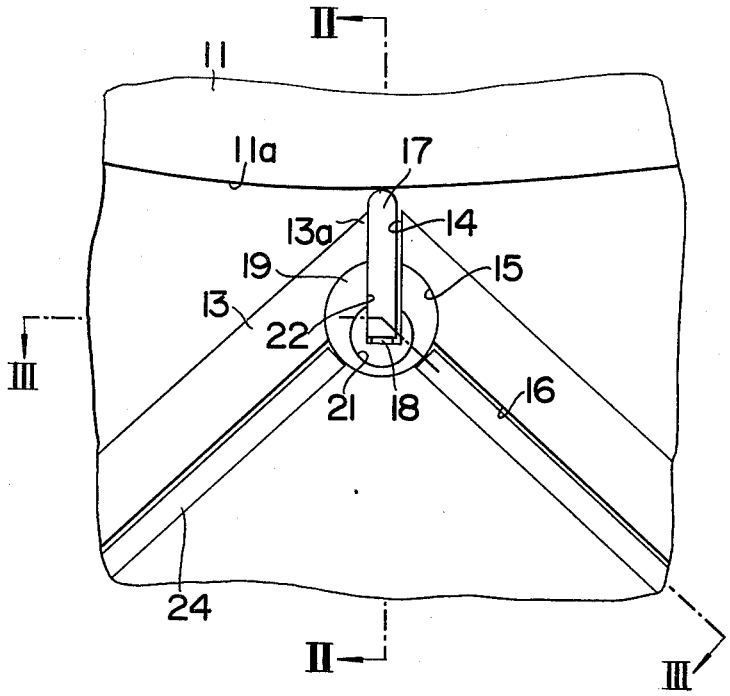
FIG. 1 is a fragmentary illustration of seal arrangement embodying the present invention.
Figure 2:
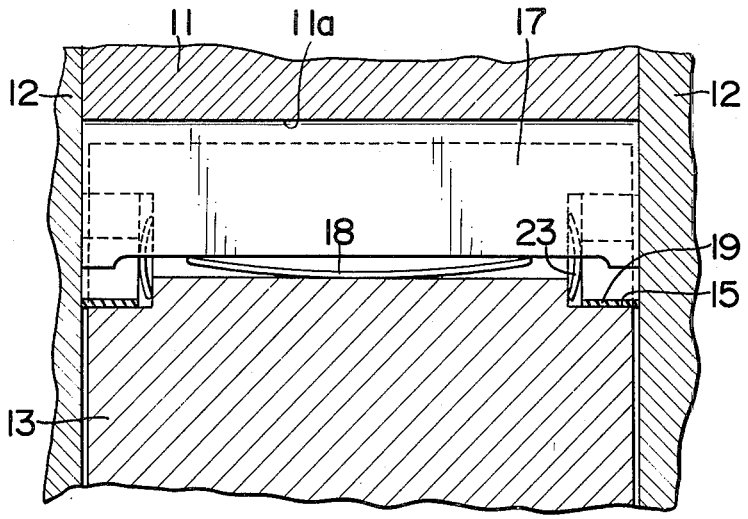
FIG. 2 is a sectional view taken substantially along the line II—II in FIG. 1.
Figure 3:
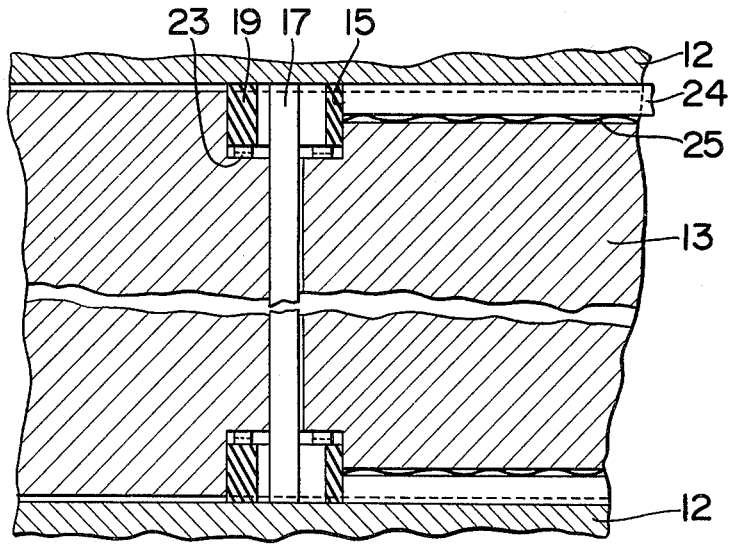
FIG. 3 is a sectional view taken along the line III—III in FIG. 1.

Referring now to the drawings, particularly to FIGS. 1 through 3, there is shown a portion of a casing which comprises a rotor housing 11 and a pair of side housings 12 sealingly secured to the opposite sides of the rotor housing 11. As shown in FIG. 1, the rotor housing 11 has an inner peripheral wall 11*a* which defines a cavity of multi-lobed or trochoidal configuration in the casing. A polygonal rotor such as a substantially triangular rotor 13 is disposed in the cavity for rotation with its apices 13*a* substantially along the inner peripheral wall 11a of the rotor housing 11. The rotor 13 is provided at each of the apices 13*a* with a groove 14 extending throughout the thickness thereof so as to accommodate an apex seal 17 therein. The apex seal 17 has a side edge projecting from the associated apex 13*a* of the rotor 13 and forced into sliding contact with the inner peripheral wall 11a of the rotor housing 11 by means of a leaf spring 18 disposed at the bottom of the groove 14.

The rotor 13 is further provided on each end face thereof at each apex portion with a cylindrical recess 15 for receiving a corner seal 19. Further, on each end face of the rotor 13, there are provided side seal grooves 16 which are formed one substantially along each side periphery of the rotor 13. The corner seal 19 has a cylindrical outer surface with a radially directed slot 22 in which an end portion of the apex seal 17 is received. The corner seal 19 is inserted into the recess 15 in the rotor 13 and forced into sliding contact with the inner surface of the adjacent side housing 12. In each of the side seal grooves 16, there is disposed a side seal 24 thoughout the length thereof. The side seal 24 is also forced into sliding contact with the inner surface of the adjacent side housing 12 by means of a corrugated spring 25 as well known in the art.

As shown in FIGS. 1 and 4, the corner seal 19 comprises a cylindrical body 20 having an axial bore 21 which is offset from the axis of the cylindrical body in a direction opposite to that of the slot 22. The slot 22 extends from the outer periphery of the body 20 to the bore 21 so as to define a substantially C-shaped cross-sectional configuration of varying thickness. The wall thickness of the corner seal 19 has maximum value at each side a adjacent to the slot 22 and gradually decreases toward the intermediate portion b. In the illustrated embodiment, the outer diameter of the corner seal 19 is slightly greater than the diameter of the seal receiving recess 15 so that the seal 19 is inserted into the recess 15 in a radially contracted condition. Thus, the seal 19 has a tendency to expand radially in the recess 15 to contact under a certain amount of pressure with the inner wall surface of the recess. It has been found that the illustrated cross-sectional configuration of the corner seal 19 is effective to provide a substantially uniform contact pressure along the peripheral surface thereof as compared with conventional corner seals. The contact pressure distribution as obtained by the corner seal 19 of the illustrated embodiment is shown in FIG. 6*a*.

The corner seal 19 may have an outer diameter which is substantially equal to or slightly smaller than the diameter of the seal receiving recess 15. Since high pressure gas is introduced through the slot 22 into the bore 21 of the corner seal 19 during operation of the engine, the seal 19 is forced to expand radially outwardly into contact with the inner wall surface of the recess. Even in this case, the illustrated cross-sectional configuration is effective to ensure substantially uniform contact pressure.

FIG. 5 shows a corner seal in accordance with another embodiment of the present invention. The corner seal 119 comprises a substantially cylindrical body 120 having an axially extending cylindrical bore 121 which is offset from the axis of the body 120 as in the previous embodiment. A slot 122 extends radially from the outer periphery to the bore 121 at the side opposite to the direction of offset of the bore 121. According to the illustrated embodiment, the outer surface of the body 120 is chamfered as shown by 130 on opposite sides of the outer surface adjacent the slot 122. The angular extent of the chamfer 130 as measured from the center of the slot 122 to the line 130*a* wherein the chamfer begins is preferably 45°. It has been found that the chamfered cross-sectional configuration of the corner seal 119 as illustrated in FIG. 5 is more effective to obtain a uniform pressure distribution than that shown in FIG. 4. In case of the corner seal 19 shown in FIG. 4, there still appears a substantial pressure near the slot 22 as noted in FIG. 6*a*, however, in the chamfered cross-sectional configuration shown in FIG. 5, the contact pressure in the vicinity of the slot 122 is substantially decreased as compared with that in the embodiment of FIG. 4 as clearly shown in FIG. 6*b*.

From the above descriptions, it will be apparent that the present invention provides a novel corner seal configuration which is effective to obtain uniform pressure distribution along the periphery thereof. Thus, the present invention is effective to attain reliable sealing for a prolonged period and eliminates the necessity of precise dimensional control of the outer diameter of the corner seal and the diameter of the seal receiving recess.

The present invention has thus been shown and described with reference to specific embodiments, however, it should be noted that the invention is in no way limited to the details of the illustrated structures but changes and modifications may be made without departing from the scope of the appended claims.

I claim:

1. In a rotary piston type engine comprising a casing which includes a rotor housing with a trochoidal inner peripheral wall and a pair of side housings sealingly secured to the opposite sides of the rotor housing, and a polygonal rotary piston disposed in the casing for rotation relative thereto and having a plurality of apex portions, the rotary piston being provided with apex seals disposed at apex portions thereof, side seals on each end surface of the piston substantially along the periphery thereof and corner seals on each end surface of the piston at the apex portions thereof, characterized by the fact that said corner seal comprises a substantially cylindrical body, an axial bore of circular cross-section radially offset from the axis of the body with the center of said axial bore located below the axis of the body, and a substantially radially extending slot provided in the body at the side opposite to the direction of offset of the bore so as to define a substantially C-shaped cross-section of varying wall thickness.

2. Rotary piston type engine in accordance with claim 1 in which said corner seal has an outer diameter which is slightly greater than the diameter of the associated corner seal recess so that the seal expands in a radial direction in the recess into pressure contact with the wall surface of the recess.

3. Rotary piston type engine in accordance with claim 1 in which said corner seal is chamfered axially at the outer surface in the area adjacent to said slot.

4. Rotary piston type engine in accordance with claim 3 in which the angular extent of the chamfered area as measured at the axis of the body from the center of the slot to the point of beginning of the chamfer is 45°.

* * * * *